US005854589A

United States Patent [19]

How et al.

[11] Patent Number: 5,854,589

[45] Date of Patent: Dec. 29, 1998

[54] METHOD AND APPARATUS FOR GENERATING AND DETECTING ACOUSTIC SIGNALS

[76] Inventors: Hoton How, 262 Clifton St., Belmont, Mass. 02178; Carmine Vittoria, 300 Commercial St., Suite 805, Boston, Mass. 02109

[21] Appl. No.: 956,241

[22] Filed: Oct. 22, 1997

Related U.S. Application Data

[60] Provisional application Nos. 60/034,008 Jan. 2, 1997 and 60/029,077 Oct. 23, 1996.

[51] Int. Cl.[6] ..... G08B 13/181

[52] U.S. Cl. ..... 340/551; 340/572

[58] Field of Search ..... 340/551, 572

[56] References Cited

U.S. PATENT DOCUMENTS

| | | | |
|---|---|---|---|
| 4,510,489 | 4/1985 | Anderson, III et al. | 340/572 |
| 4,622,543 | 11/1986 | Anderson, III et al. | 340/572 |
| 4,644,310 | 2/1987 | Anderson, III et al. | 335/215 |
| 4,647,917 | 3/1987 | Anderson, III et al. | 340/572 |
| 4,710,709 | 12/1987 | Anderson, III et al. | 324/207.17 |
| 4,720,676 | 1/1988 | Anderson, III et al. | 324/207.17 |
| 4,727,668 | 3/1988 | Anderson et al. | 40/625 |
| 4,727,888 | 3/1988 | Luke | 131/84.1 |
| 4,822,543 | 4/1989 | Iizuka et al. | 264/521 |
| 4,868,915 | 9/1989 | Anderson, III et al. | 340/825.31 |
| 4,999,609 | 3/1991 | Crossfield | 340/572 |
| 5,563,583 | 10/1996 | Brady et al. | 340/572 |
| 5,565,847 | 10/1996 | Gambino et al. | 340/572 |

*Primary Examiner*—Glen Swann
*Attorney, Agent, or Firm*—Nutter, McClennen & Fish, LLP; Christopher S. Daly

[57] ABSTRACT

A magnetic/acoustic transducer is disclosed. The transducer can be used in security/smart tag applications. The transducer includes a sensor tag made of magnetic metallic glass having a relatively high magnetostriction and a relatively low coercivity. Driving signals are provided by an rf dipole loop antenna. The tag responds to the rf signals and converts the exciting magnetic field into acoustic signals via magnetoelastic coupling. That is, the tag is forced to vibrate in unison with the incident electromagnetic signals generating longitudinal acoustic waves along a length of the tag. This results in radiation of ultrasound waves in air which can then be detected and characterized using an ultrasound microphone or a piezoelectric sensor. The tag is provided having a length equal to one half or one quarter long of an acoustic wavelength so that an acoustic resonance condition is established to maximize the generation of ultrasound waves in air. The measured ultrasound signal is locked in phase with the excitation or reference signal for sensitive long-range detection. The tag can operate in a magnetized or a demagnetized state to stimulate binary signals for security-tag applications. Tags of different length and/or geometry can be deployed in combination so that the tag transducer produces unique and distinguishable frequency spectrums to be used as smart tags.

1 Claim, 11 Drawing Sheets

METHOD AND APPARATUS FOR GENERATING AND DETECTING ACOUSTIC SIGNALS

GOVERNMENT RIGHTS

Not applicable.

RELATED APPLICATIONS

This application is a continuation of provisional application No. 60/029,077 filed, Oct. 23, 1996 and provisional application No. 60/034,008, filed Jan. 2, 1997.

BACKGROUND OF THE INVENTION

This invention is generally related to the design and fabrication of security and smart tags that generates acoustic waves in air to be detected via acoustic sensors. More particularly, this invention relates to the design and fabrication of a novel and improved tag system which can respond to electromagnetic driving signals in terms of acoustic waves using an efficient scheme to facilitate sensitive long-range transmission and detection.

As is known in the art, security-tag systems are used in libraries, grocery stores, clothing, video and other merchandise outlets, etc. . . . to monitor items and detect movement of equipment such as the movement of equipment in factories to location of infants in hospital nurseries. Smart tags are presently used for a number of applications in the civilian and military sectors, including item identification, toll passes, and barrier identification. For security-tag applications the tag can generate two levels of identification indicating the state of the tag being interrogated. For a security tag its state can be interchanged via some external means. For smart tags they are required to generate multi-levels of identification, usually a predetermined property of the tag not subject to change. For both tag-system applications the traditional approach always involves the use of electromagnetic dipole antennas for detection, detecting the response of the tag utilizing some nonlinear structure of the tag circuitry. As such, the response signal from the tag is very weak, being at best a second-order effect of the employed detection scheme. Thus, the detection can be relatively difficult or in some instances impossible due to the existence of noise in the surrounding environment. Furthermore, noise can cause a detector to falsely produce an alarm signal. Furthermore, current smart tags are relatively expensive and carry a limited amount of information.

What is needed for operation of a security/smart tag system is to set up an interrogation zone (usually defined by a magnetic dipole antenna pair) near an entrance or an exit of an area to be secured or classified. When the electromagnetic field in the interrogation zone is perturbed by a suitable object (e.g. a "tag", "marker", or "label") the system detects the perturbation. The "tags" can be electrical or magnetic. The perturbation signal must be of a nature that it can be resolved from a signal produced by a drive antenna and distinguishable from noise signals generated by other equipment and objects in and around the interrogation zone.

Conventional techniques of system design for security/smart tags involve the use of magnetic tags and/or other electronic elements including Doppler shifting circuits and varactors and diodes. Upon interrogation, the tag reacts with an input electromagnetic signal to generate electromagnetic radiation which differs from an original electromagnetic field either in frequency (frequency-domain characterization) or in waveform (time-domain characterization). For both frequency- and time-domain detections the employed tags are generally required to possess high degree of nonlinearity so that high-order harmonics or waveform distortions can be effectively generated and detected.

For both systems, a transmit antenna must focus its energy into the interrogation zone, not in directions where it could interfere with other electronic equipment: cash registers, computers, scanners, or other electronic systems. The receive antenna must be sensitive to the weak response of a tag which may fill only one part in $10^{10}$ of the interrogation zone. It must not trigger an alarm in response to electrical signals from the transmit antenna, or from other electrical equipment or magnetic objects. Magnetic shielding is therefore required for these antennas to improve the efficiency of a traditional tag system.

The shielding material should have none of the characteristics of the type of tag for which the system is designed. This is obvious, but it is not trivial to achieve because the shield is much closer to the antenna and has a volume $10^7$ to $10^8$ times greater than that of the tag. Specifically, the shields must be very linear in their electromagnetic response and especially free of harmonics in the frequency range of the tag for frequency-domain detection, or, the shields must not show much waveform distortion in the time-scale characterizing the imposed electromagnetic pulses for time-domain detection.

SUMMARY OF THE INVENTION

It is therefore an object of the present invention to provide a security/smart tag system to overcome the aforementioned difficulties encountered in the prior art.

Specifically, it is an object of the present invention to provide a security/smart tag system in which ultrasounds, instead of electromagnetic waves, are detected in an interrogation zone. This can be achieved via the use of magnetostrictive tags. Since ultrasound can effectively propagate in air, it provides an extended method in long-range detection for the interrogated signals.

Another object of the present invention is to provide sensitive detection of the enhanced transducer signal. Through the use of a resonant structure of the tag, the generation of ultrasounds becomes actually a first-order effect, and, hence, its response can be much more readily detected.

Another object of the present invention is to provide essentially noise-free detection. By locking-in the detector phase with the transmitter, one can effectively amplify the signal voltage to many orders without amplifying the accompanying noise. This facilitates greatly signal detection.

Another object of the present invention is to provide a suitable choice of the tag material. In order to produce maximum magnetomechanical coupling, magnetic tags possessing maximum magnetostriction coefficient are preferred. Also, in order to fully saturate the magnetomechanical coupling effect, the tags are preferably provided having a magnetic coercive force which is selected to be relatively low. Another benefit from low coercive field tags is that the drive required from the exciting magnetic field can be significantly reduced which translates into lowering costs of a security system utilizing such tags. In order not to dissipate ohmic heat, and, hence, to increase the transducer efficiency, the tags are preferably provided having a relatively low conductivity characteristic. For the same reason, the tag shall exhibit minimal hysteresis loop. Based on the above considerations, a material such as amorphous $Fe_{40}Ni_{40}B_{20}$ may be used as the tag materials. Iron and/or nickel may be replaced by other transition metals or rare-earth metals to affect a high magnetostriction tag material. Other considerations for tag materials include low conductivity and small magnetic hysteresis loops, as required by maximum power-conversion (magnetic to mechanical) efficiency.

Another object of the present invention is to provide a simplified detection scheme for the tag systems. Since noise is minimized in the detection scheme and multi-path reflection is much less important as compared with the traditional systems, the need for magnetic shield is therefore minimized and in some applications may even be totally eliminated.

Another object of the present invention is to provide cost-effective production of the tags. Since the tags may be cut directly from cold-rolled amorphous magnetic foils, the tags can be manufactured relatively inexpensively. For example, in some applications the cost of a security/smart tag can be as low as only a few cents. Power input to the current driver can be reduced and, therefore, costs by utilizing high magnetostriction and low coercive-field magnetic foils.

Another object of the present invention is to provide a smart tag which occupies a relatively small volume but which stores a relatively large amount of information. This is achieved by deploying many tags of different length and geometry in a single package. Each of the tags operate at a different frequency. Thus each package can provide a different frequency distribution in a frequency-domain characterization.

Another object of the present invention is to provide more security over items seeking protection. For example, while metal sheets with high conductivity and permeability can conceal the radiation from a traditional security tag, such sheets cannot block the propagation of acoustic waves generated from tags manufactured in accordance with the present invention.

Briefly, in a preferred embodiment, the present invention discloses a novel technique for converting an electromagnetic interrogation field into ultrasonic waves via the use of a magnetostrictive transducer tag. The tag is arranged in mechanical resonance with the source signal whose phase is locked to an acoustic detector to facilitate sensitive long-range detection. Since acoustic detection disclosed in the present invention minimizes noise interference, there is no need to use a magnetic shield as required by a traditional tag system. Also, the propagation of ultrasounds cannot be blocked by a magnetic metal sheet. Fabrication of the tag system is inexpensive, and the information contained in a smart tag unit can be abundant, limited only by the resolution of the acoustic detector.

It is an advantage of the present invention that it provides a security/smart tag system in which ultrasounds, instead of electromagnetic waves (rf-magnetic field), are being detected in the interrogation zone. This can be achieved via the use of magnetostrictive tags. Since ultrasounds can effectively propagate in air, it provides an extended method in long-range detection for the interrogated signals.

Another advantage of the present invention is to provide sensitive detection of the enhanced transducer signal. Through the use of a resonant structure of the tag, the generation of ultrasound becomes actually a first-order effect, and, hence, its response can be much more readily detected.

Another advantage of the present invention is to provide essentially noise-free detection. By locking-in the detector phase with the transmitter, one can effectively amplify the signal voltage to many orders without amplifying the accompanying noise. This facilitates greatly signal detection.

Another advantage of the present invention is to provide a suitable choice of the tag material. In order to produce maximum magnetomechanical coupling, magnetic tags possessing maximum magnetostriction coefficient are preferred. Also, in order to fully saturate the magnetomechanical coupling effect, the tags should preferably exhibit minimum magnetic coercive force. In order to dissipate less heat, the tags are preferably provided having a relatively low conductivity and minimum hysteresis loops. For these reasons amorphous $B_{20}T_{40}R_{40}$ may be ideally used as the tag materials, where T can be iron, and R another transition metal, Ni, Co, and/or their alloys. It may also be possible to use rare-earth metal alloys for R and T. Other considerations for tag materials include low conductivity and small magnetic hysteresis loops, as required by maximum power-conversion (magnetic to mechanical) efficiency.

Another advantage of the present invention is to provide a simplified detection scheme for the tag systems. Since noise does not participate actively in the detection procedure and multi-path reflection is much less important as compared with the traditional systems, the need for magnetic shield is therefore totally eliminated.

Another advantage of the present invention is to provide cost-effective production of the tags. Since the tags can be cut directly from cold-rolled amorphous magnetic foils, their costs can be very low. For example, the cost of a security/smart tag can be as low as only a few cents.

Another advantage of the present invention is to provide more information that a smart tag can carry in a reduced volume. This is achieved by deploying many tags of different length and geometry in one unit to arrive at different frequency distribution under frequency-domain characterization.

Another advantage of the present invention is to provide more security over items seeking for protection. For example, while metal sheets with high conductivity and permeability can conceal the radiation from a traditional security tag, they can hardly block the propagation of acoustic waves generated from the present device.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
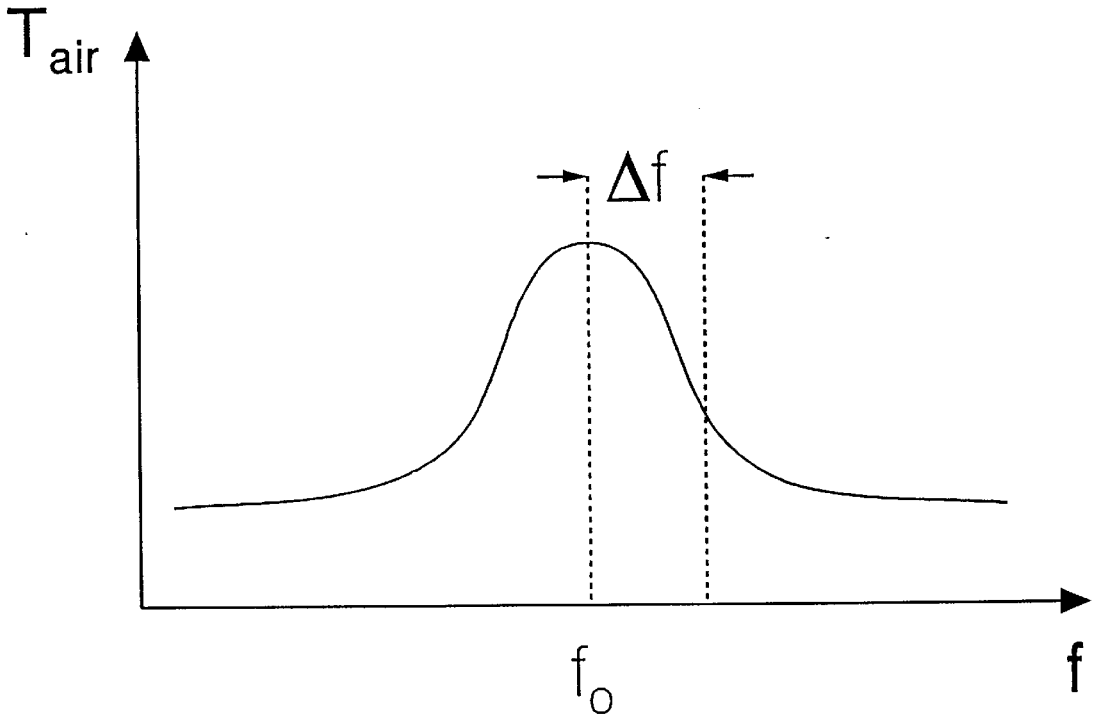
FIG. 1 is a plot of generated stress field in air, $T_{air}$, as a function of frequency, f.

Since environmental noise generated by electrical motors and traffic vehicles are generally below 50 kilo-Hertz (kHz), this dictates that a preferred acoustic system shall operate above 50 kHz to avoid these noise signals. Also, the tag is desired to have minimal length or size, which translates into high frequency operation of the transducer tag, since the tag is of a length equal to one half or one quarter of the imposed acoustic wavelength. However, for ultrasounds to propagate effectively in air, the operation frequency cannot be too high, since the attenuation constant of (longitudinal) acoustic waves, denoted as $\alpha$, is proportional to the square of the frequency, denoted as f. In air at room temperature, $\alpha$=0.006 dB/m for f=60 kHz. Therefore, the optimal frequency range for a tag system to operate is from 50 kHz to about a few hundreds of kilo-Hertz.

To achieve mechanical resonance, the length of the tag denoted as l, is required to equal one half or one quarter of the acoustic wavelength, denoted as $\lambda$. That is, $l=\lambda/2$ if both ends of the tag are unloaded, or $l=\lambda/4$ if one end of the tag is unloaded and the other end of the tag is rigidly clamped. In solids $\lambda$ may be written as $$\lambda = \frac{1}{f}\sqrt{\frac{C}{\rho}}, \tag{1}$$

where C denotes the elastic modulus and $\rho$ the mass density of the tag material.

For $C=2.0\times10^{12}$ erg/cm$^3$, $\rho$=7.8 g/cm$^3$, Eq.(1) implies $\lambda$=8.4 cm for f=60 kHz, for example.

Upon interrogation the tag sample will vibrate in unison with the incident electromagnetic (rf-magnetic) field at the same frequency. As such, electromagnetic energy is converted into kinetic energy and this energy is transferring at a rate of $$P = \frac{C}{2}\, s^2 f \frac{V}{2}, \tag{2}$$

where V is the volume of the tag and s is the induced strain equal to the value of magnetostriction at a particular bias field strength $H_0$ as will be discussed below in conjunction with FIG. 2. In Eq.(2) the acoustic field has been assumed to be a sinusoidal distribution along the tag over a length of $\lambda/2$ or $\lambda/4$. Assume a fraction, F, of the total power is transferred into air as ultrasonic waves propagating in air away from the tag 20 sample. This implies the following relationship.

$$\frac{P\cdot F}{4\pi r^2} = \frac{1}{2}\,\frac{T_{air}^2}{u_{air}\,\rho_{air}}, \tag{3}$$

where r denotes the distance from the tag, $u_{air}$ sound velocity in air, $\rho_{air}$ mass density of air, and $T_{air}$ the generated stress field in air. Combining Eqs.(2) and (3) one obtains $$T_{air} = \frac{s}{r}\sqrt{\frac{Cf\,VFu_{air}\,\rho_{air}}{8\pi}}. \tag{4}$$

As an order of estimate, the following values are assumed: $V=1.45\times10^{-2}$ cm$^3$, $C=2.0\times10^{12}$ erg/cm$^3$, $s=10\times10^{-6}$, r=100 cm, F=0.1, f=60 kHz, $u_{air}=3.43\times10^4$ cm/s, and $\rho_{air}=1.24\times10^{-3}$ g/cm$^3$. The generated stress field in air is, from Eq. (4), $T_{air}$=1.71 dyn/cm$^2$=0.171 Pa. This stress field can be readily detected using a microphone probe equipped with a preamplifier, for example, probe type 4138, preamplifier type 2633/70, and adaptor type UA0160 (Bruel & Kjaer Instruments, Inc., Decatur, Ga.).

In Eq. (4) the energy transferring factor F depends on the coupling between the tag and its surrounding air. It is expected that maximum coupling efficiency results if the tag is driven at mechanical resonance, say, the tag is of a length equal to one-half or one-quarter the acoustic wavelength. Also, F will increase if the tag is backed up by a cavity served as a cushion (transformer) layer as shown, for example, in FIGS. 3 and 4 below. However, the particular dimension of a cavity should provide optimal coupling coefficient of F and may be determined in any particular system using empirical techniques including iterative empirical techniques.

FIG. 1 is a plot of $T_{air}$, or $\sqrt{F}$, as a function of frequency f. In FIG. 1 the term $f_0$ denotes the frequency at which mechanical resonance occurs and $\Delta f$ denotes half the line width. The quality factor Q is defined as $Q=f_0/\Delta f$. It should be noted that Q is an important factor in designing efficient tag transducers for smart-tag system applications: Q relates to the resolution power of the tag system in the frequency domain. When a maximum amount of data is desired to be packed across a fixed frequency range, Q is preferably selected having a value which is as large as possible.

Figure 2:
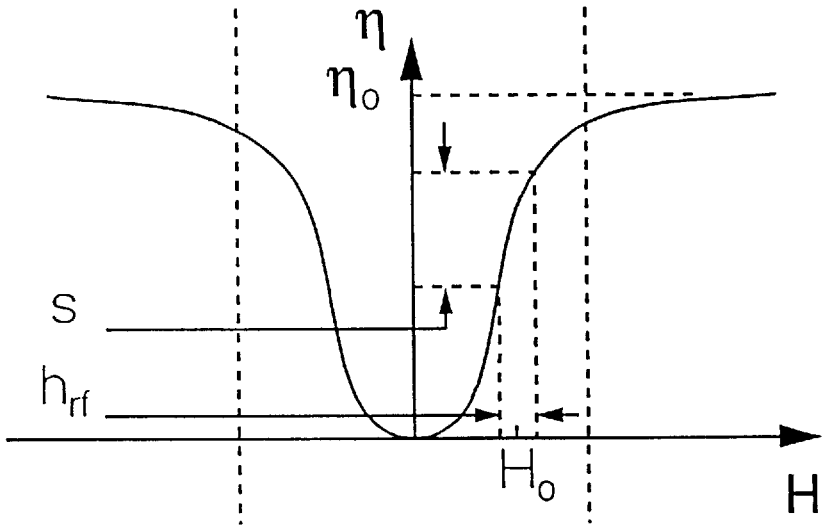
FIG. 2 is a plot of magnetostriction ($\eta$) as a function of a bias magnetic field, H.
Figure 2A:
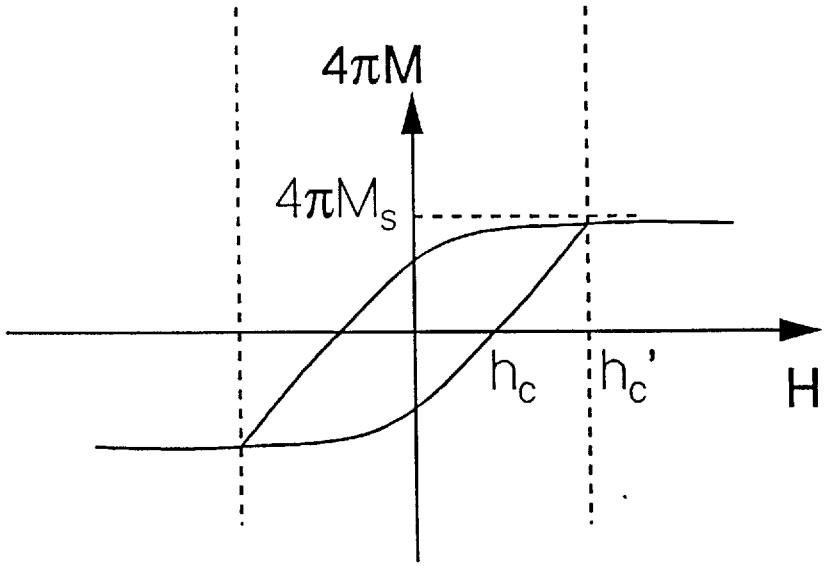
FIG. 2A is a plot of magnetization ($4\pi M$) as a function of a bias magnetic field (H)

FIG. 2 is a plot of magnetostriction of the tag, $\eta$, as a function of the bias magnetic field, H. In FIG. 2A $h_c'$ denotes the magnetic field beyond which the magnetization value $4\pi M$ and the magnetostriction value $\eta$ corresponds to a saturated magnetization value $4\pi Ms$ and a saturated magnetostriction value $\eta_0$. When the tag is biased at a magnetic field strength of $H_0$ and the driving rf-field is of a magnitude $h_{rf}$, the induced rf-strain field is then given as s. Therefore, for an efficient tag system design, it is desirable to maximize $\eta_0$ to induce maximal strain and to minimize $H_c$, the coercive force, or $H_c'$, the saturation force, so that minimal $h_{rf}$ is required to generate a given amount of strain field, s.

The tag is preferably provided from a material such as amorphous $Fe_{40}Ni_{40}B_{20}$ manufactured by (Metglass Products, Parsippany, N.J.). This material is provided having a saturation magnetization, $4\pi M_s$=10 kG, $H_c$~0.1–0.3 Oe, remanence, $4\pi M_r$~1–2 kG, $\eta_0=14\times10^6$, and a conductivity, $\sigma$, which is about one tenth that of metal iron. It should be noted that low $\sigma$ value is advantageous, since the tag then dissipates less energy as ohmic heat. Those of ordinary skill in the art will appreciate of course that other materials or combinations of materials having similar material characteristics and electrical and magnetic properties may also be used.

The amount of strain, s, induced by a fixed rf field, $h_{rf}$, depends on the bias condition of the film, $H_0$. In FIG. 2 it is seen that s is minimum if $H_0$ is close to 0 (demagnetized state), whereas s is a maximum if $H_0$ reaches $_c'$ (magnetized state). Therefore, one may apply a piece of semi-hard magnetic material adjacent to the soft tag to control the magnetization state of the tag. For example, a strip of Arnokrome®, Crovac®, or Vically®, of dimension comparable to that of the tag, can provide the bias field having a magnetic field strength typically of a few Oe which is required to hold the tag near its optimal magnetoelastic coupling point near $H_c'$ shown in FIG. 2A. If the semi-hard magnet ($H_c$~50–100 Oe) is demagnetized, the tag becomes demagnetized and hence the sensor is deactivated.

Thus, the tag can provide two levels of acoustic radiation, Eq.(4), characterizes the state of the tag controlled by the semi-hard magnet. This is the situation that a security-tag applies. Therefore, say, when a merchandise item equipped with a security tag has not been authorized for checking out, the tag is in the activated state which will consequently alert the alarm. However, after checking out the semi-hard magnet is demagnetized and the tag is deactivated so that the alarm will no longer be alerted.

Figure 3:
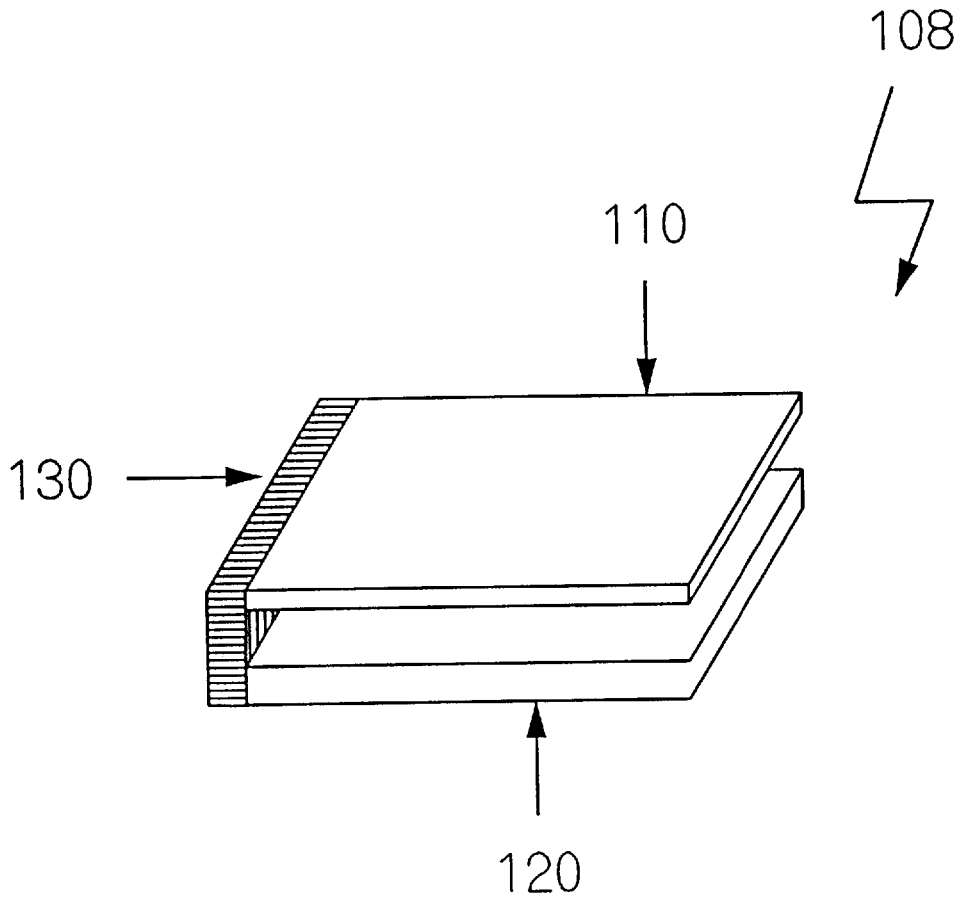
FIG. 3 is a perspective view of a tag which may be appropriate for use in a security system.

Referring now to FIG. 3, a tag 108 includes a first tag portion 110 which may be provided, for example, from a material such as amorphous $Fe_{40}Ni_{40}B_{20}$, a semi-hard magnet portion 120 and a base portion 130 which may be provided from a non-magnetic material and to which tag portions 110, 130 may be coupled using bonding via glue or epoxy or other fastening techniques. The base 130 may be provided, for example, from non-magnetic stainless steel, or plastic which may be injection molded or any other non-magnetic material from which a low cost, durable base may be provided. In FIG. 3 the tag 110 and the semi-hard magnet 120 are brought face to face, spaced by a predetermined distance. Here, the space between the facing surfaces is filled with air although in some embodiments it may be desirable to fill the space with some other dielectric. The tag 110 is affixed to the magnet 120 at one end of its length 130; the other end of the tag 110 is set free. This sets the boundary conditions for a mechanical $\lambda/4$-resonator.

For smart-tag applications the requirement for interchangeable magnetization states of the tag element is relaxed. As such, the need for a semi-hard magnet is eliminated, $H_0$ =0, and the driving field $h_{rf}$ in FIG. 2 is generally required to exceed $H_c'$ to optimally excite the strain field in the tag. However, instead of using a single piece of magnetoelastic element, multi-elements shall be used. It should be noted that in some applications it may be desirable to provide a tag having multiple magnetic status and a detector having a sensitivity which allows detection of the different magnetic states.

Figure 4:
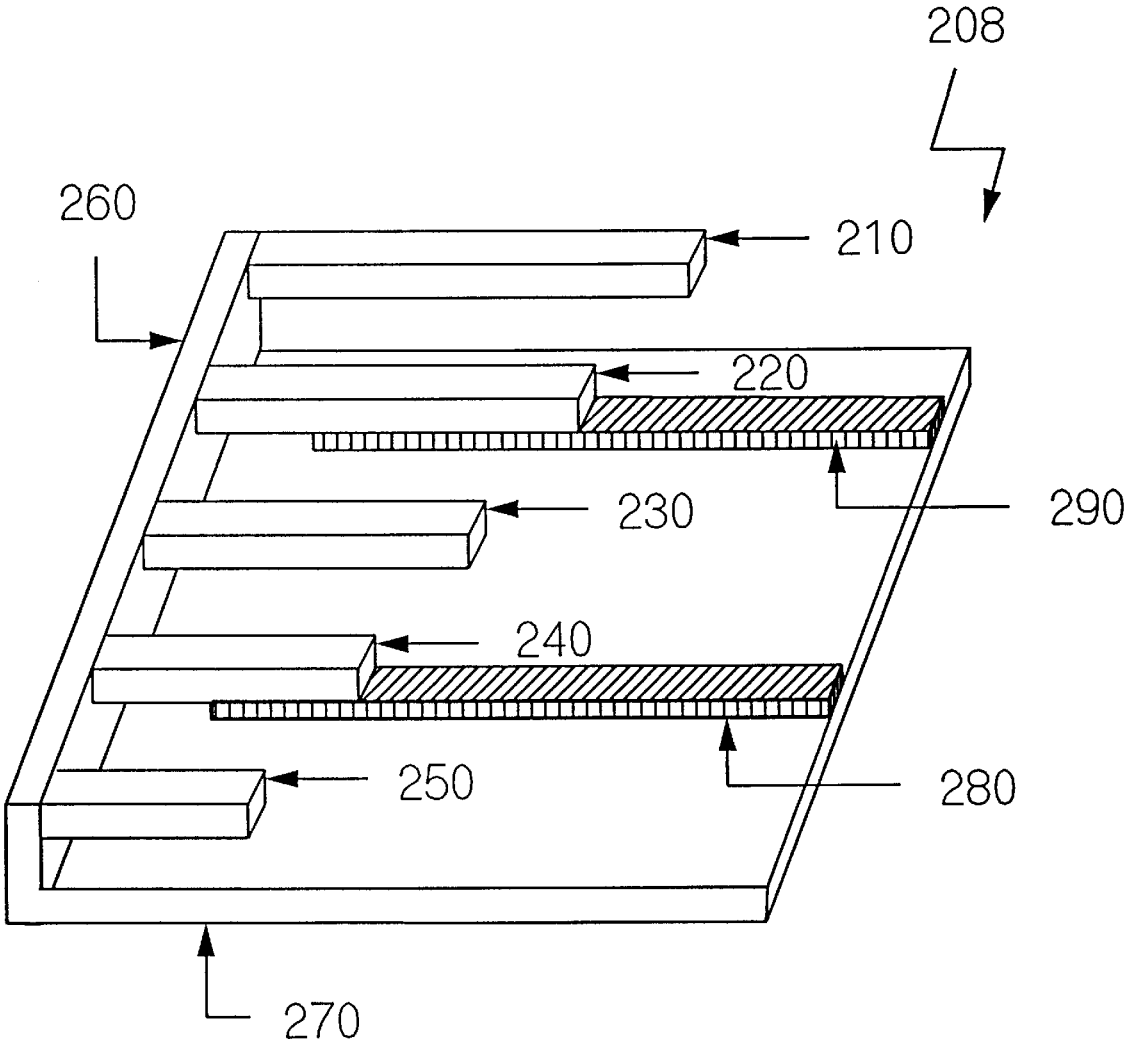
FIG. 4 is a perspective view of a tag which may be appropriate for use in an identification system.

Referring now to FIG. 4 a smart-tag 208 contains five tag elements or resonators, denoted as 210, 220, 230, 240, and 250, respectively. Tag elements are coupled to a side wall 260 to form quarter-wave resonators. In one embodiment tag elements 210–250 are attached rigidly to side wall 260 but those of ordinary skill in the art will appreciate of course that in some embodiments tag elements 210–250 may be removably coupled to side wall 260. For example, tag elements may be coupled to side wall 260 via a snap-on connection, a tongue and groove connection or any other connection technique known to those of ordinary skill in the art. Again, air cushion is formed between the tags 210–250 and a bottom plate 270 so as to enhance the Q values of the resonators. The length of the tag elements 210–250 differ and thus they resonate at different frequencies, denoted as $f_1$, $f_2$, $f_3$, $f_4$, and $f_5$, respectively. The tag elements 210–250 thus function as five mechanical resonators which are provided having Q values which are large enough to result in the (ultrasonic) radiations being unambiguously distinguished by a detection circuit such as the detection circuit described below in conjunction with FIG. 5.

Therefore, upon interrogating these five tag elements using their respective resonant frequencies, $f_1$ to $f_5$, one is able to tell the existence of these tag elements and thus the existence of tag 208. The operation of one or more of the resonators 210–250 can be prevented via a resonator blocker 280, 290. In one embodiment the operation of some of the tag elements 210–250 can be blocked by using mechanical damping layers, say, rubber strips, disposed underneath one or more of elements 210–250 the tag. This is shown in FIG. 4 where blockers 280 and 290 are used to block operation of tag elements 240 and 220, respectively. The blockers are disposed between and in contact with at least one portion of a resonator such as resonators 210–250 and a portion of a bottom plate 270. In one particular embodiment, the blockers project from a first surface of bottom plate 270. The blockers may be provided as pieces separate from bottom plate 270 in which case the blockers are preferably fastened to the bottom plate 270 utilizing glue, epoxy, ultrasonic welding or other welding techniques or any other fastening technique well known to those of ordinary skill in the art. Alternatively in some applications it may be desirable to provide the blockers as an integral part of base plate 270 using injection molding, milling or any other manufacturing techniques known to those of ordinary skill in the art.

The particular tag system of FIG. 4 includes five resonators 210–250 of which resonators 220, 240 are blocked by blockers 280, 290. Thus the tag 208 of FIG. 4 stores binary information of (10101). In a system which includes five resonators, thirty-two different combinations of resonators may be provided by selecting different combinations of blockers. It should be noted that other systems may include fewer or greater than five resonators and thus other systems may be provided having fewer or greater than thirty-two different resonator combinations.

Although the tag elements can be arranged side by side in a linear array of resonators as shown in FIG. 4, they can also be packed together one above another in a planar or non-planar array geometry to reduce the overall packaging volume. Also, it is not necessary to have a rectangular geometry. For example, a triangular tag or tag element, or a circular tag or tag element, or combinations of any shaped tags and tag elements including arbitrarily shaped tags and tag elements, can be readily characterized by scanning the frequency in the interrogation zone. As such, almost an unlimited amount of information can be stored in the tag, to be limited only by the resolution power of the detection circuit. The particular shape used for tags and tag elements depends upon a variety of factors including, but not limited to, the cost and ease with which such tags and tag elements can be provided as well as the required strength of signals provided by the tag.

Figure 5:
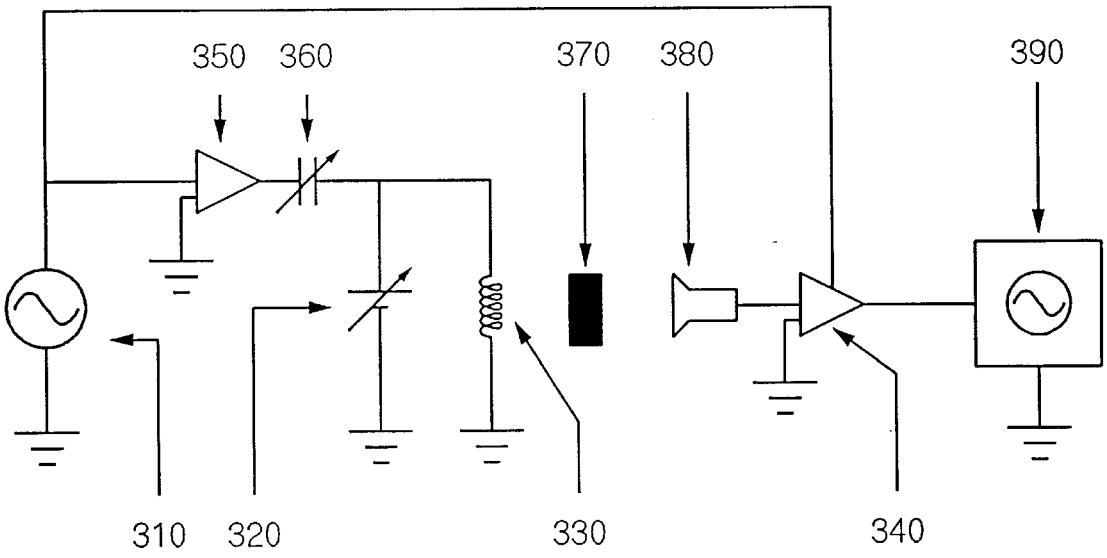
FIG. 5 is a schematic diagram of an electromagnetic interrogation signal generating circuit, and an acoustic detection circuit.

Referring now to FIG. 5, driving and detection circuits of the tag system are shown to include a function generator 310 which generates sinusoidal signals at frequencies dictated by a tag 370 which may be one of the types described in conjunction with FIGS. 3, 4 or 6–8. This signal is fed to a power amplifier 350 to drive a dipole antenna 330 which may, for example, be provided in the form of multiple loops. However, in order to effectively feed the antenna, a capacitor 360 with variable capacitance is inserted in the driving circuit to cancel the inductance of the antenna loop.

Antenna 330 emits an interrogation signal in an interrogation zone. A dc bias 320 is also used in FIG. 5, which generates a dc field in the interrogation zone to offset any remanent field (earth field) there. The detection circuit includes a microphone 380 as the front end receiver. Microphone 380 may be one of the types manufactured by Polaroid Corporation and included as one of the 7000 series Electrostatic Transducers. Those of ordinary skill in the art will appreciate of course that other microphones having similar characteristics may also be used. The particular microphone selected should be able to detect signals emitted by a tag. The microphone is fed to a lock-in amplified 340 whose phase is locked with the source generator 310. The amplified signal can then be observed and then manipulated from a PC console 390. It should be noted that antenna 330 and microphone 380 may be disposed in physically separate areas of a location in which the system is disposed.

Figure 6:
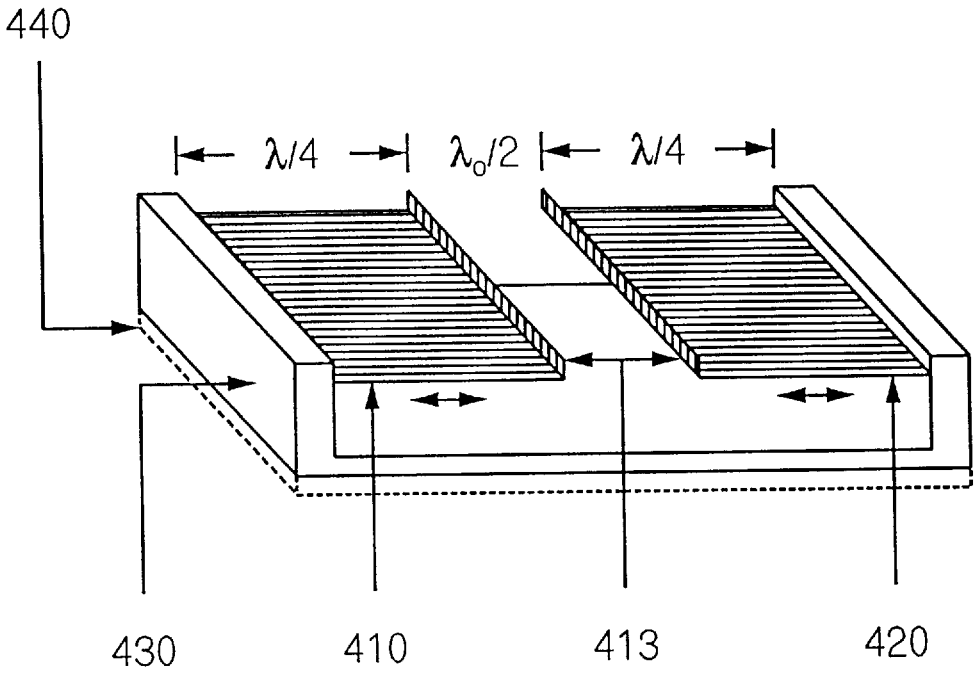
FIG. 6 is a perspective view of another embodiment of a tag.
Figure 7:
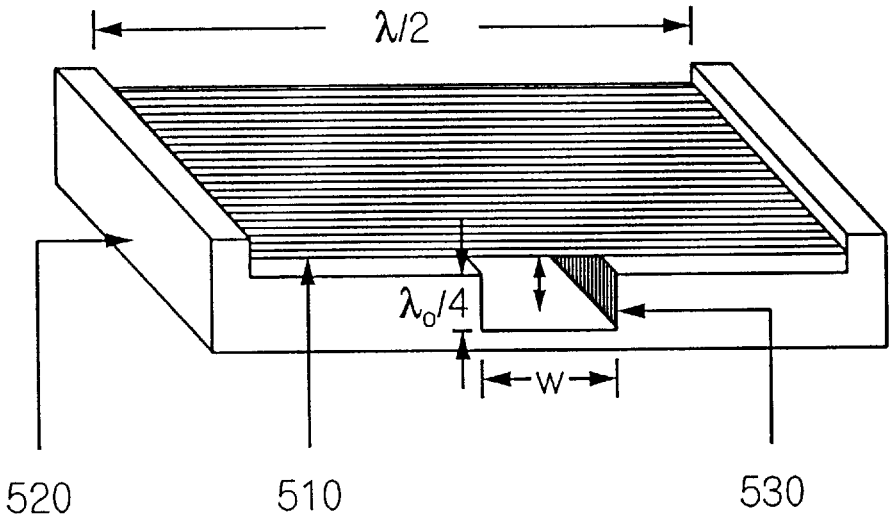
FIG. 7 is a perspective view of yet another embodiment of a tag.
Figure 8:
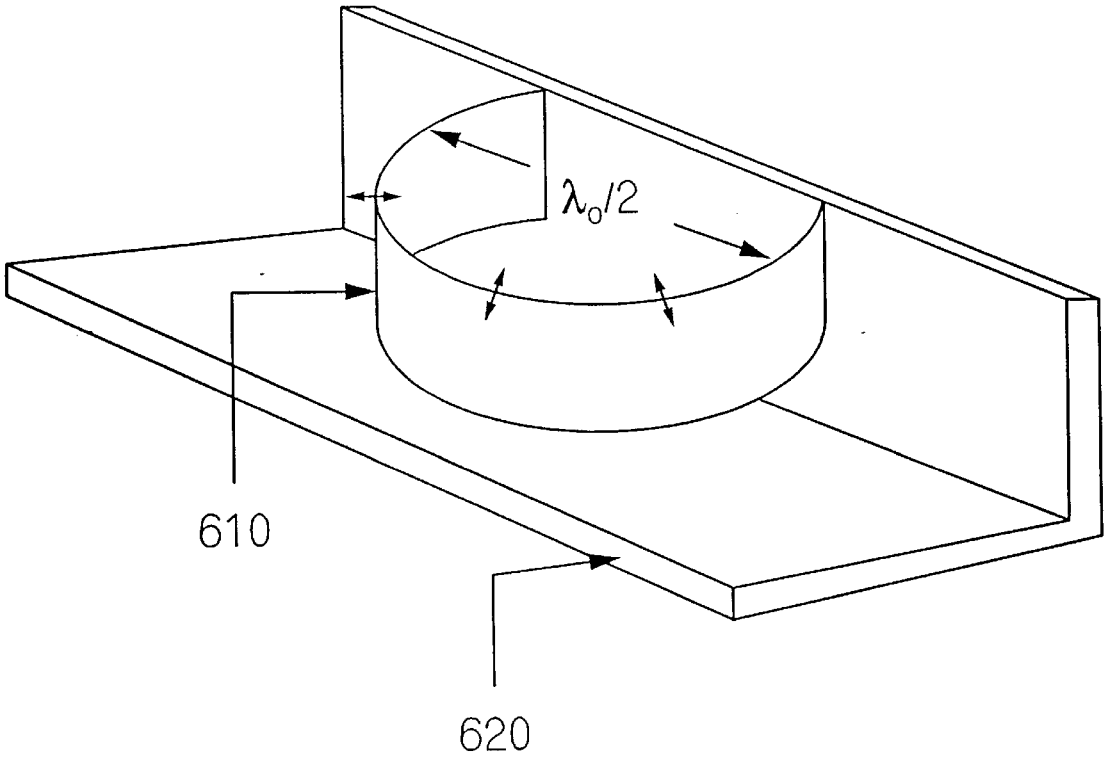
FIG. 8 is a perspective view of still another embodiment of a tag.

Analogous to tag configurations shown in FIGS. 3 and 4, other possible alternatives are also suggested in FIGS. 6 to 8.

Referring now to FIG. 6, a tag 408 includes a plurality of magnetoelastic tag elements, 410 and 420 coupled as a unit to act as a dipole source to excite acoustic waves in air. The tag elements 410 and 420 are provided having a length corresponding to one-quarter of a wavelength of the acoustic waves in the tag element material. The tag elements are separated by a distance $l_0$ equal to one-half the wavelength of the ultrasonic waves as measured in air. Since the tag elements 410, 420 move in horizontal directions as indicated by arrows 411, in order to beat air efficiently, the tags' edges 413 are bent into vertical positions, since the tag elements 410, 420 are expanding/contracting in the horizontal direction when responding to the driven interrogation signals. The tag elements 410, 420 are attached to a fixed frame 430 to form $\lambda/4$ resonators. A semi-hard magnet (here shown in phantom and denoted 440) may be disposed under the frame as for the security tag-system applications.

FIG. 7 is derived from FIG. 6 where the dipole source is realized in the form of a resonant cavity cut as a slot 530 in a frame 520. The slot is of a depth $\lambda_0/4$, corresponding to a quarter wavelength of the ultrasonic waves in air. A magnetoelastic tag element 510 is suspended across the frame 520, fixed at both ends to serve as a $\lambda/2$ resonator. Here $\lambda$ denotes the acoustic wavelength in the tag element material. Therefore, upon responding to the interrogation signals, the tag element expanding/contracting horizontally, as indicated by arrow 511, converting into vertical vibrational motion of the tag, because the total horizontal length of the tag element 510 is fixed by the fixed frame 520. This results in excitation of standing acoustic modes in the slot 530 which then emits ultrasounds. The width W of the slot 530 is selected in accordance with a variety of factors including, but not limited to, the length of tag element 510 and the depth D of slot 530. The particular slot width W used in a particular application may be determined empirically using iterative techniques and selected to result in optimal detection characteristics in a detection system. A semi-hard magnet may be disposed under the frame as for the security tag-system applications, for example, as discussed above in conjunction with FIG. 6.

Another variation of the embodiments shown in FIGS. 6 and 7 is shown in FIG. 8 where the magnetoelastic tag 610 is bent into a arc whose diameter is $\lambda_0/2$, one half the wavelength of ultrasounds in air. The tag 610 is of a length $\lambda/2$, one half the acoustic wavelength in the tag, which is attached to the frame 620 at both ends. As such, the tag resonates with the interrogation signals, converting the tangential motion of the tag into vibrational motion of the arc, results in ultrasonic radiation in air. The tag configuration shown in FIG. 8 may be ideally used for smart-tag applications, since many tags of different length may be bent into concentric arcs affixed to a common frame. When compared to FIG. 4, this can save the volume of the tag system drastically.

Figure 9:
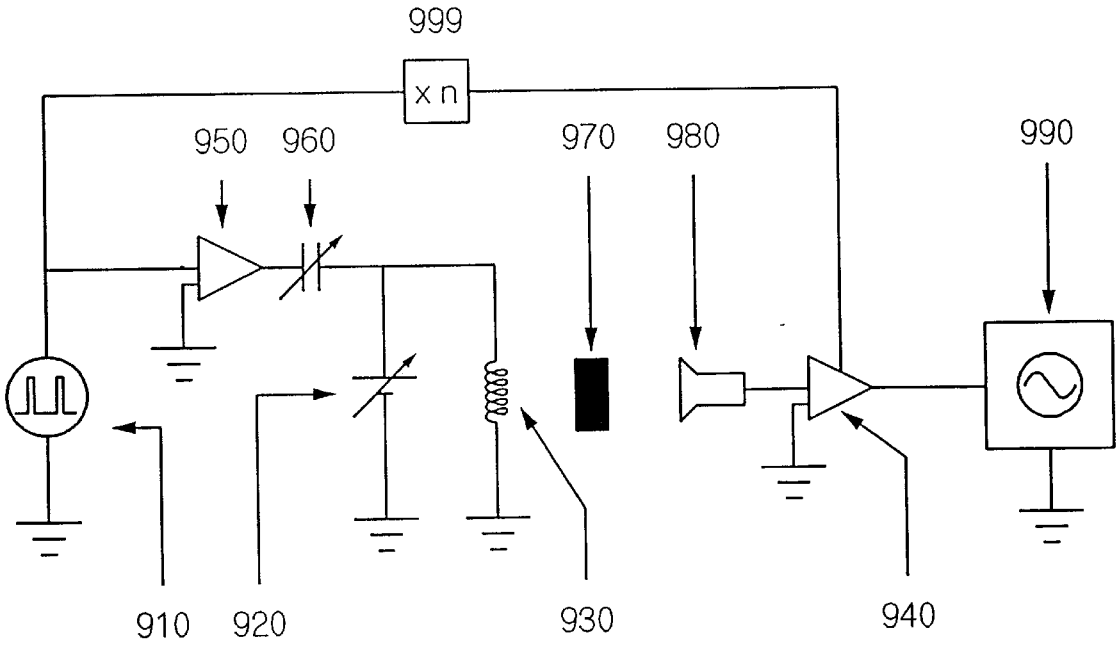
FIG. 9 is a schematic diagram of a tag system.

Instead of utilizing the forced resonance driving condition of the tag system as described in FIG. 5, one may apply a similar technique involving the detection of beating frequencies at higher harmonics, as shown in FIG. 9. That is, in FIG. 9 the signal generator 910 now generates pulses of short duration at a sub-harmonic frequency of the tag system 970, denoted as $f_0/n$. The pulses excite the tag system during the active cycle of the pulses, relaxing into intrinsic oscillations of acoustic waves at a frequency $f_0$ when the pulses become inactive. As such, ultrasonic waves will transmit in air, which are most pronounced if the ultrasound frequency beats with the driving frequency. For this reason, we have included in FIG. 9 a frequency multiplier 999 which multiplies the source signal by a factor of n. The multiplied signals are then, as before, fed into the lock-in amplifier 940 to effectively enhance the signal-to-noise ratio of the detection scheme. Elements 920, 930, 950, 960, 970, 980, 940 and 990 have operating characteristics and functions which are similar to elements 320, 330, 350, 360, 370, 380, 340 and 390 described above in conjunction with FIG. 5.

The present invention thus discloses a preferred embodiment which comprises a source circuit excite sufficient rf-current to drive a dipole antenna. The antenna is placed in the interrogation zone and transmits electromagnetic signals to enquire/check the status of the tags. The tags are magnetomechanically reactive, and thus translate the incident electromagnetic waves into outgoing ultrasonic waves which are then detected using a microphone sensor. The detector circuit is phase locked with the source circuit so that background noise can be excluded.

The present invention also discloses a method for optimizing the resolution power of the detector circuit. The quality factor, Q, of the acoustic radiator has been increased by incorporating a cavity cushion with the tag resonator. As such, chances for false alarms can be greatly reduced for the security-tag applications, and the storage capacity for information can be optimized for the smart-tag applications.

Therefore, the present invention teaches the Electronic Article Surveillance (EAS) industry a new technique in fabricating security and smart tag systems. This invention discloses the use of ultrasonic waves in the detection of, say, the forced resonant states of magnetostrictive tag samples. The invented technique will provide sensitive detection of the tag status over long distance, simplify the detection circuit with added reliability, decrease the chances for false alarms, increase the amount of information that a smart-tag system can carry, and to lower the fabrication costs of the tags.

Figure 10:
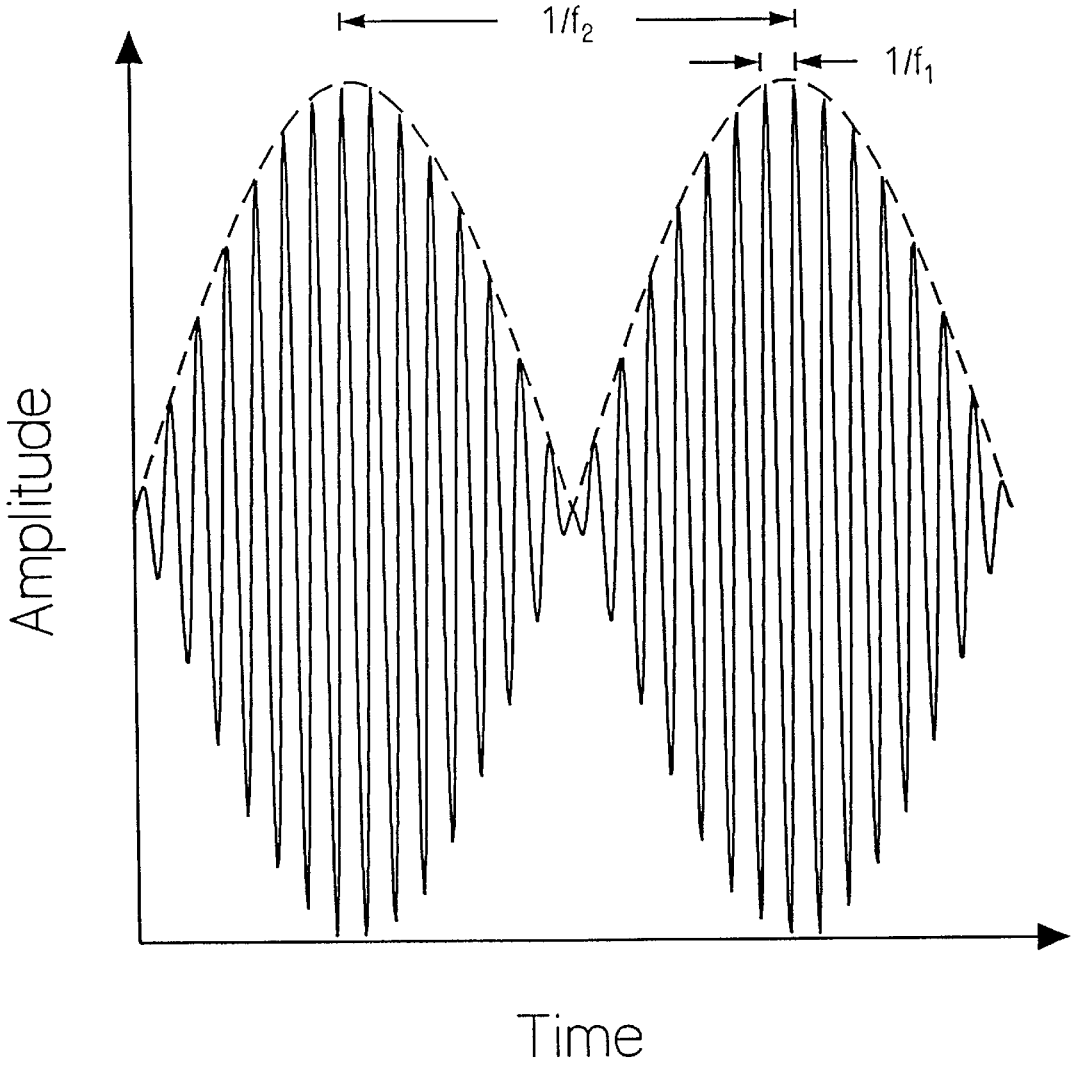
FIG. 10 is a plot of an amplitude modulated interrogation signal.

In order to efficiently couple the electromagnetic field with the vibrational motion of the tag, a two-stage frequency conversion scheme may be used. The excitation field is provided having a relatively high frequency typically in the range of about 1 MHz to 10 GHz. The particular frequency is selected based upon a variety of factors including but not limited to the coupling efficiency of the selected transducer materials. The detection signal is provided having a frequency $f_2$ which is in the ultrasound frequency range. For example, the detection signal may be provided having a frequency typically in the range of about 20 KHz 200 KHz. This allows sensitive acoustic detection in air. Thus, the interrogation signal is composed of two frequencies, the carrier frequency $f_1$ and the modulation frequency $f_2$, and the waveform can be amplitude, phase, or frequency modulated. FIG. 10 shows the interrogation signal which is amplitude modulated.

Three advantages follow as a consequence of using a two-stage frequency conversion scheme. Firstly, since $f_1$ is much larger than $f_2$, the detection circuit tuned at $f_2$ filters out signals at $f_1$, and, hence, reducing interference between transmitting and receiving electronics. Secondly, interrogation signals with carrier at $f_1$ and modulation at $f_2$ can be conveniently generated by using a conventional microwave source, for example, a Traveling Wave Tube (TWT) at desired power levels, say, from a few Watts to a few hundreds of Watts. Most importantly, the radiated electromagnetic energy can be confined in space near the interrogation zone to reduce power consumption as well as to avoid multi-path reflection arising from objects outside the interrogation zone. For this purpose the interrogation zone is constructed using a pair of disk-antenna reflectors and a ground plane arranged face-to-face so that electromagnetic waves are reflected back and forth between them to form standing modes within the interrogation zone.

Figure 11:
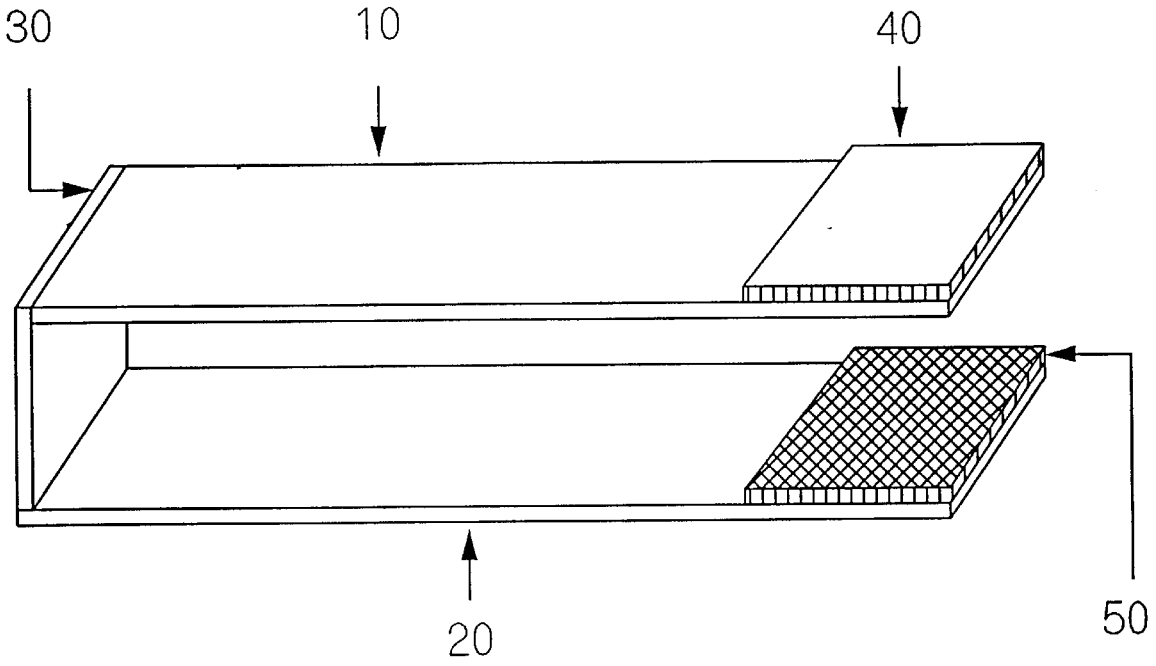
FIG. 11 is a perspective view of still another embodiment of a tag.

Thirdly, the transducer materials that generate acoustic waves can be conveniently chosen based upon either their electric or magnetic properties. For electric transducers piezoelectric materials, like piezoelectric ceramics (PZT-class) at low frequencies ($f_1 \leqq 10$ MHz), quartz crystals at intermediate frequencies (10 MHz$\leqq f_1 \leqq$1 GHz), and sapphire crystals at high frequencies ($f_1$>1 GHz) can be used. For magnetic transducers magnetostrictive materials such as amorphous/poly-crystalline ferromagnetic alloys containing iron, nickel, cobalt, or boron, as well as rare-earth/transition metal compounds may be used to generate the acoustic wave in the magnetic film at high frequencies. A third material class which can also be used as the transducer material includes $Ni_2MnGa$, $Co_2MnGa$, FePt, CoNi, and FeNiCoTi, etc. For these materials, martensitic phase transitions can be magnetically induced near room temperature, and, hence, appreciable mechanical strains will result near phase transitions in these materials. The aforementioned transducers are shown in FIG. 11 as element 40, which is either acoustically bonded or evaporated/deposited on top of a ferromagnetic metal strip, element 10. The assembly of 10 and 40 vibrates as a unit with $f_2$ being the normal-mode frequency. However, in order to transition smoothly from the transducer 40 to the vibrator substrate 10, a buffer layer may be needed between them, which also serves as the matching layer to compensate the difference in (acoustic) impedance between the transducer and the vibrator substrate.

Therefore, upon application of the interrogation signal of FIG. 10, for example, electromagnetic energy will drive the system to vibrate at $f_2$, since $f_1$ is too high for the tag assembly 10 and 40 to follow mechanically. That is, the mechanical tag system is set to resonate at $f_2$ and not at $f_1$. This results in the generation of ultrasounds, which can then be measured using a detection system similar to that illustrated in FIG. 9. Again, the measured ultrasound is phase-locked with the modulation signal at $f_2$ to enhance its signal-to-noise ratio.

In FIG. 11, element 50 represents a damper, which can be brought in contact with tag 10 to stop the vibrational motion of the tag. The damper can be made of a thin sheet of rubber glued on top of a second magnetic tag shown as element 20 in FIG. 11. Both tags, 10 and 20, are affixed to a common supporter, element 30, which is made of magnetic-soft metal, for example, permalloy. Tags 10 and 20 are provided from semi-hard materials, which can be magnetized externally/manually with respective magnetization either parallel or anti-parallel to each other. Thus, when magnetization of the tags is along the same direction, they repel each other, resulting in undamped vibrational motion of tag 10 at $f_2$.

However, when the tags are magnetized in opposite directions, they attract each other so that the damper 50 is in physical contact with the tag 10. This reduces or in some instances eliminates the vibrational motion of the tag 10. Thus, depending on the magnetization state of the tags, 10 and 20, the tag system can respond differently to the interrogation signal, corresponding to the checked and unchecked states of the merchandise that is intended to be protected by the tags. It should be noted that in some embodiments, both supporter 30 and the damper 50 can be omitted, resulting in a simpler structure. That is, when tags 10 and 20 attract each other, they join together to form one unit which exhibits different vibrational frequencies as previously assumed at $f_2$. This gives rise to different reaction of the tag system in response to the interrogation signal when compared to that when they are repelling each other.

The third advantage is that we can incorporate the enhanced magnetic resonance mechanism into the detection scheme to increase the coupling between the incident electromagnetic waves and the resultant spin motion in tag 20. This utilizes the so-called ferromagnetic resonance (FMR) or spin-wave resonance (SWR) In this case, tag 10 can be magnetized externally to different state providing various bias field to tag 20. Consequently, when tag 20 is biased with a signal having an FMR or SWR frequency coincident with the driving frequency of $f_1$, the coupling efficiency is relatively high and in some cases may be maximized, giving rise to a relatively large amount of acoustic generation. However, by varying the bias field provided by tag 10, the FMR or SWR frequencies are altered. This results in reduced amount of acoustic generation, and hence it can be distinguished from the previous state involving FMR/SWR resonance. For this configuration there is no need for the transducer 40 and the damper 50 shown in FIG. 10. Instead, the tag system resembles that shown in FIG. 3 with tag 110 being the ferromagnetic metal, for example, nickel, and tag 120 being a semi-hard magnet whose magnetization can be controlled externally.

Thus, the system can employ a two-stage frequency conversion scheme in which a signal at one frequency is responsible for the generation of electromagnetic waves in space in the interrogation zone, and a signal at another frequency corresponds to the normal-mode vibrational frequency of the tag.

Also, with the present invention, the interrogation zone can be confined in space involving electromagnetic radiation in standing modes constructed using a pair of reflectors and a ground plane.

In the system of the present invention, the transducer can be realized either electrically or magnetically. For electrical transducers, piezoelectric materials can be used, whereas for magnetic transducers, magnetostrictive materials can be used. Materials involving magnetically induced martensitic transition near room temperature can also be used as the transducer materials.

Also, in the present invention, FMR or SWR phenomena can be incorporated with the tag-detection scheme to further amplify the resolution power of the security-tag system.

Having described preferred embodiments of the invention, it will now become apparent to one of skill in the art that other embodiments incorporating the concepts may be used. Thus, the invention is not be limited to the particular embodiments disclosed herein, but rather only by the spirit and scope of the appended claims.

What is claimed:

1. A tag comprising:

a base having first and second opposing surfaces;

a side wall having a first surface coupled to the first surface of the base; and a resonator having a first end coupled to a second surface of said side wall.

* * * * *